US005954027A

United States Patent [19]

Suzuki

[11] Patent Number: 5,954,027

[45] Date of Patent: Sep. 21, 1999

[54] SENSOR FOR ENGINE CONTROL

[75] Inventor: Masaru Suzuki, Hamamatsu, Japan

[73] Assignee: Sanshin Kogyo Kabushiki Kaisha, Hamamatsu, Japan

[21] Appl. No.: 08/941,585

[22] Filed: Sep. 30, 1997

[30] Foreign Application Priority Data

Sep. 30, 1996 [JP] Japan ..... 8-259273

[51] Int. Cl.[6] ..... F02P 3/08

[52] U.S. Cl. ..... 123/406.57; 123/600

[58] Field of Search ..... 123/600, 406.57, 123/149 D

[56] References Cited

U.S. PATENT DOCUMENTS

| | | | |
|---|---|---|---|
| 3,367,314 | 2/1968 | Hirosawa et al. | 123/600 |
| 4,108,131 | 8/1978 | Shibukawa | 123/600 |
| 4,141,331 | 2/1979 | Mallory, Jr. | 123/600 |
| 4,285,321 | 8/1981 | Phelon et al. | 123/600 |
| 4,343,273 | 8/1982 | Kondo et al. | 123/600 |
| 4,449,497 | 5/1984 | Wolf et al. | 123/600 |
| 4,610,237 | 9/1986 | Ionescu et al. | 123/600 |
| 4,697,570 | 10/1987 | Ionescu et al. | 123/600 |
| 4,949,696 | 8/1990 | Muller et al. | 123/600 |
| 5,050,553 | 9/1991 | Erhard | 123/600 |
| 5,584,280 | 12/1996 | Kinoshita et al. | 123/406.57 |

*Primary Examiner*—Erick R. Solis
*Attorney, Agent, or Firm*—Knobbe, Martens, Olson & Bear LLP

[57] ABSTRACT

A number of embodiments of ignition systems and specifically a combined charging and triggering device that utilizes a single winding and a core having a pair of ends that are juxtaposed to a rotating magnet. A number of different embodiments are illustrated in combination with CDI ignition circuits and in one embodiment the necessity of diodes in the circuit is eliminated.

8 Claims, 7 Drawing Sheets

SENSOR FOR ENGINE CONTROL

BACKGROUND OF THE INVENTION

This invention relates to a sensor for an engine control and more particularly to an improved sensor and CDI arrangement for firing the spark plugs of an internal combustion engine.

In connection with spark-ignited internal combustion engines, it is a common practice to utilize a CDI ignition system for firing the spark plugs. This type of system employs an electrical circuit in which a capacitor is charged by a charging coil. A solid state device then is controlled by a further signal from the engine so as to provide a timing indication and this signal is utilized to ground the capacitor and induce a voltage in the primary winding of a spark coil for firing the spark plug. This type of system is quite effective and permits adjustments in the time curve to be made without utilizing mechanical devices as was formerly required.

FIG. 1 illustrates a conventional type of CDI spark ignition system and will be described in detail so as to point up several disadvantages of the conventional-type system normally utilized. As seen in the upper view of this figure, the ignition system is indicated schematically and it includes a terminal 11 that is connected to a spark plug. The terminal 11 is in circuit with the secondary winding of a voltage step-up spark coil 12.

A voltage is induced through this spark coil by a CDI ignition system identified generally by the reference numeral 13 and shown in full detail in the middle view of this figure. The CDI system operates in the manner previously described so as to discharge a capacitor to induce a current voltage in the primary winding of the spark coil 12 so as to fire the spark plug through the terminal 11. The CDI unit 13 cooperates with a flywheel-driven device, indicated generally by the reference numeral 14, and which includes the flywheel 15 on which a plurality of permanent magnets 16 are mounted. These magnets 16 cooperate with a fixed charging coil 17 and a pulser or trigger coil 18, both of which output their signals to the CDI unit 13.

Referring now specifically to the middle view of this figure, it will be seen that the charging coil 17 charges a capacitor 19 through a diode 21. A solid state switching device, such as an SCR 22, is provided in a circuit to the ground through a further diode 23. This circuit is also in parallel with the primary winding 24 of the step-up spark coil 12. The secondary winding 25 is in circuit with the gap of the spark plug associated with the terminal 12, which spark plug is indicted schematically at 26 in this figure.

Finally, the pulser or trigger coil 18 is in circuit with a switching circuit 27 that switches the SCR 22 so as to permit the capacitor 19 to discharge to the ground through the diode 23 and induce a voltage in the primary winding 24 for firing the spark plug.

As may be seen from the lower portion of FIG. 1, the charging coil generates a sinusoidal wave, the positive segments of which are utilized to charge the capacitor 19 through the diode 21. The capacitor charge is shown in the middle range curve of this view and it will be seen that the capacitor reaches its maximum charge at about the time when the charging coil output reaches its maximum and this charge is then held due to the presence of the diode 21 in the charging circuit.

This charge is maintained until the pulser coil 18, through cooperation with the switching circuit 27, outputs the signal to switch the SCR 22 to a conductive state so that the capacitor 19 can discharge and fire the spark plug. Thus, the charge on the capacitor is held for a time $t_i$.

This system, although extremely effective, does have some areas where it could be improved upon. The first of these is that it requires two separate sensing devices in the form of separate windings and two separate magnets. This not only adds to the cost of the system, but also somewhat dictates the time at which the spark plugs can be fired due to the requisite spacing of the magnets 16 and the associated coils 17 and 18. In addition, this type of system does require the utilization of the diode 21 so as to permit the capacitor to hold its charge and not discharge through the charging coil 17.

It is, therefore, an object of this invention to provide an improved and simplified CDI ignition system.

It is a further object of this invention to provide an improved CDI ignition circuit that permits the use of a simplified and single sensor for both charging the capacitor and triggering its discharge.

It is a still further object of this invention to provide an improved CDI ignition system that permits a wider latitude in the timing of firing of the spark plugs.

SUMMARY OF THE INVENTION

This invention is adapted to be embodied in an ignition circuit for firing a spark plug in an internal combustion engine. The ignition circuit is comprised of a circuit for energizing a primary winding of a step-up voltage coil. This circuit is comprised of a capacitor and a solid state switching device for effecting discharge of the capacitor for inducing a voltage in the primary winding. A single electromagnetic device is provided for both charging the capacitor and effecting the switching of a solid state device through cooperation with at least one magnet rotatable relative to the single electromagnetic device. The single electromagnetic device is comprised of a core surrounded by a winding. The core has its opposite ends disposed in spaced relationship to the magnet for inducing two pulses in the coil upon the relative rotation.

in the view "a", schematically a prior art-type of CDI ignition system;

in view "b", he electrical circuitry associated with the firing of the spark plug; and In view "c", the status of the charging coil capacitor and pulser coil.

Figure 2:
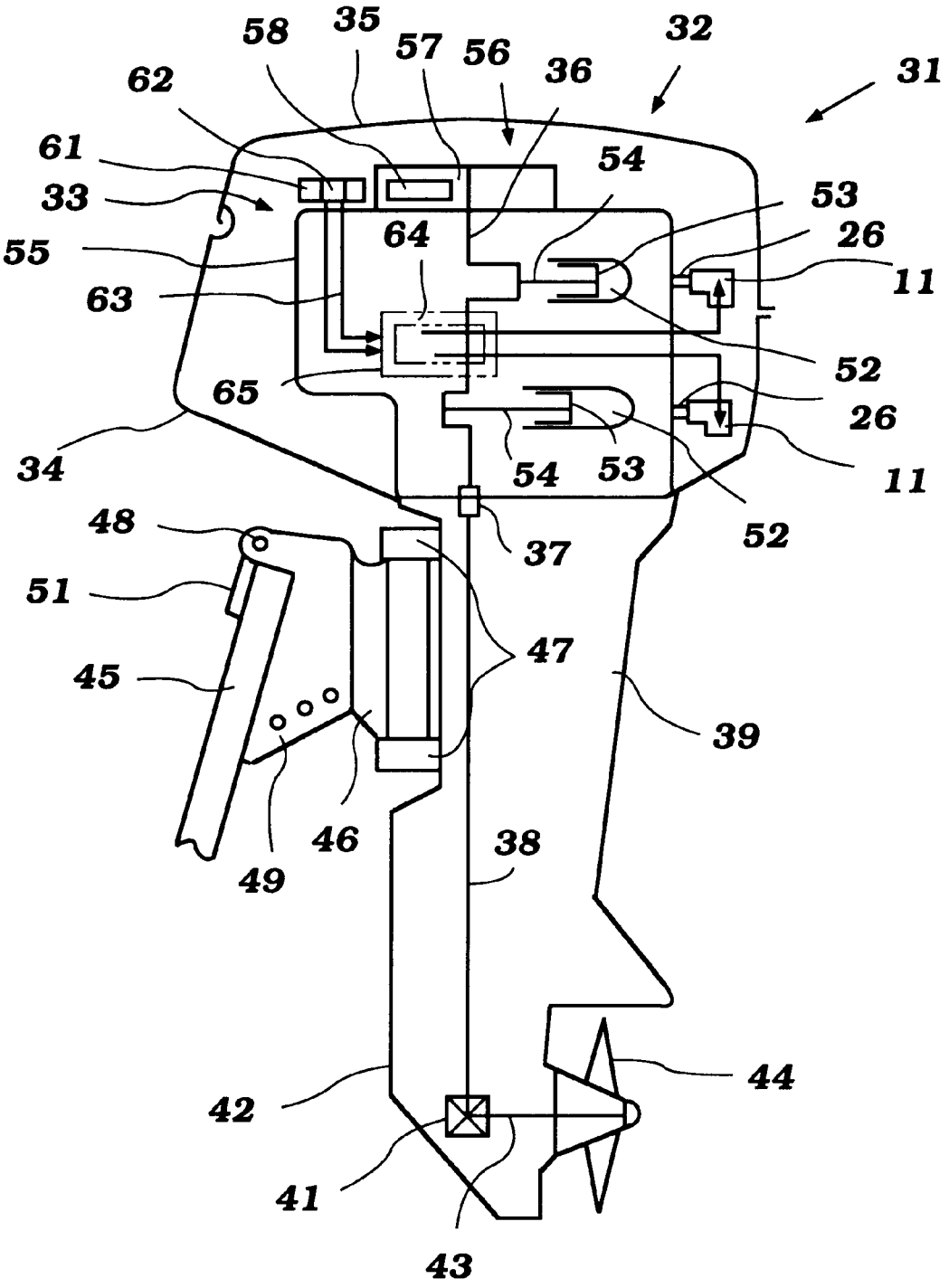

FIG. 2 is a partially schematic side elevational view of an outboard motor having a CDI ignition circuit constructed in accordance with a first embodiment of the invention.

Figure 1A:
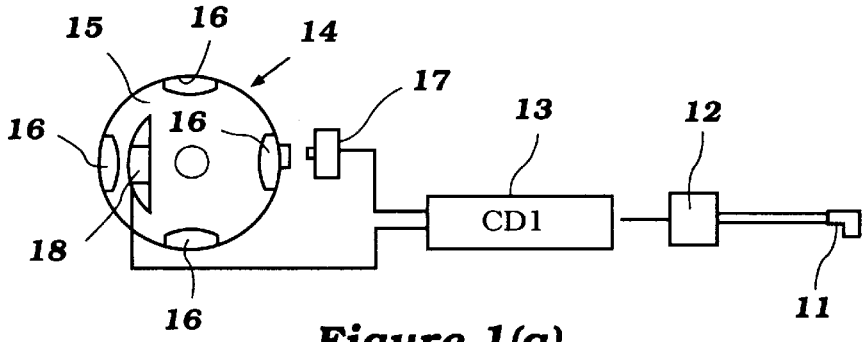
Figure 1(a) Prior Art
FIG. 1 is a three-part Prior Art view showing.
Figure 3:
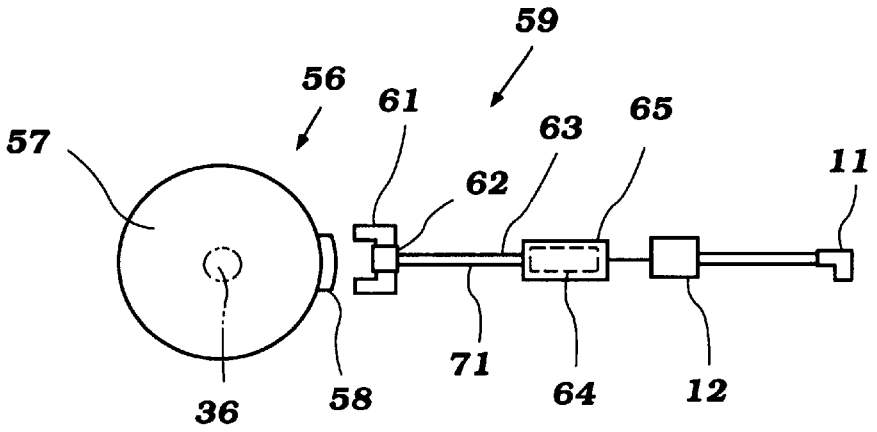

FIG. 3 is a schematic view, in part, similar FIG. 1*a*, and shows the ignition system in accordance with this embodiment.

Figure 1B:
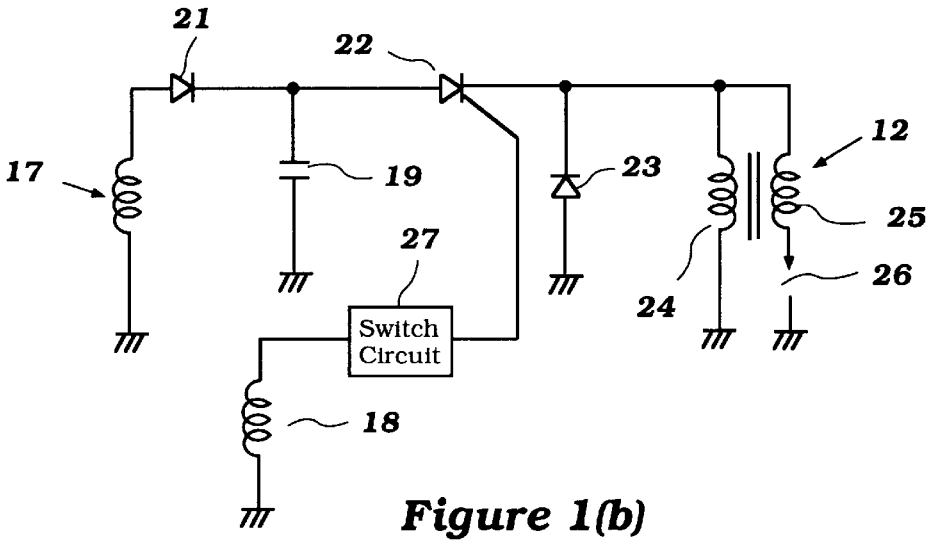
Figure 1(b) Prior Art
Figure 4:
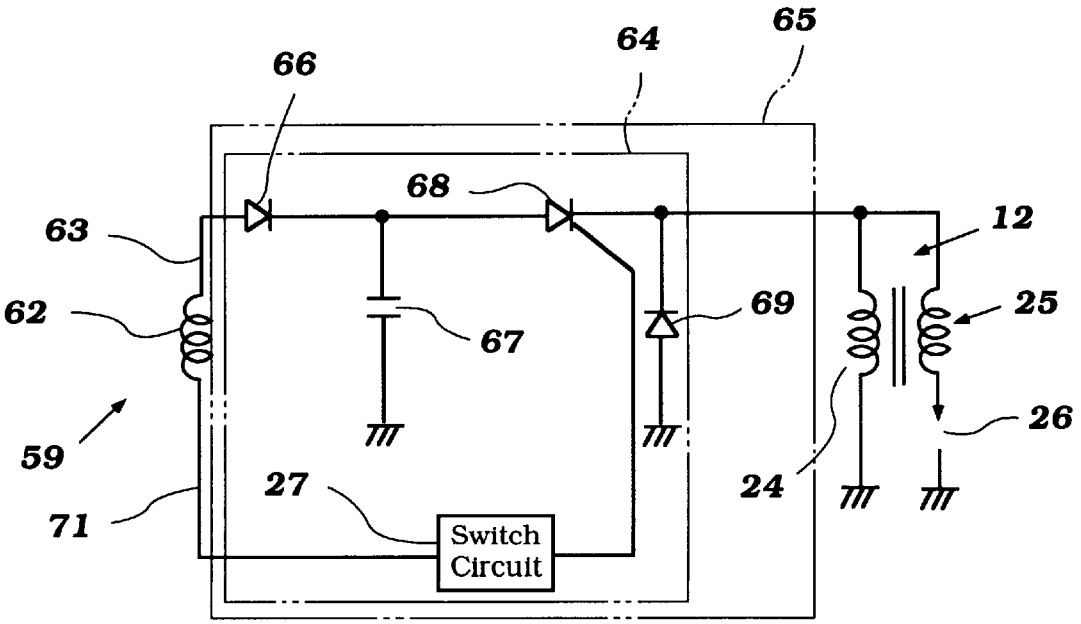

FIG. 4 is an electrical schematic diagram, in part, similar to FIG. 1*b*, but showing the arrangement of this embodiment.

Figure 1C:
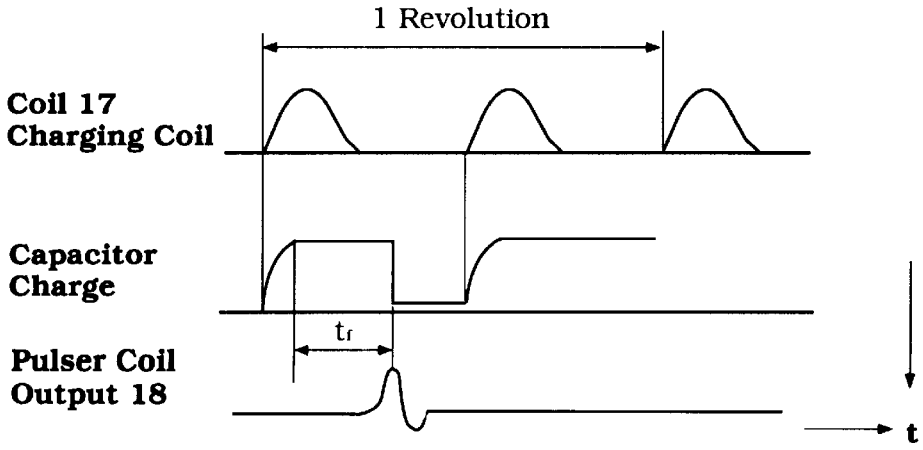
Figure 1(c) Prior Art
Figure 5:
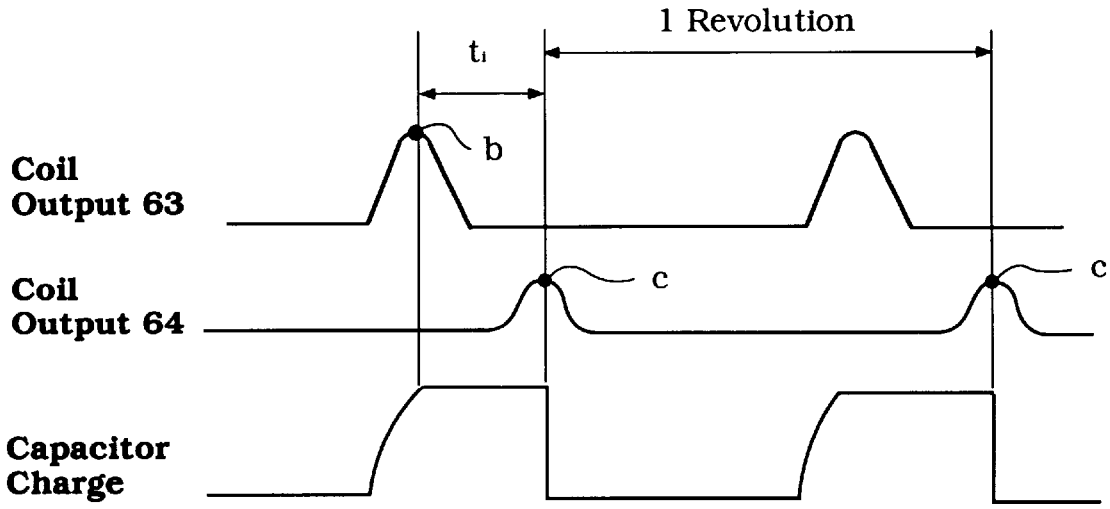

FIG. 5 is a graphical view, in part, similar to FIG. 1*c*, and shows the status of the outputs from the coil and the charge on the capacitor.

Figure 6:
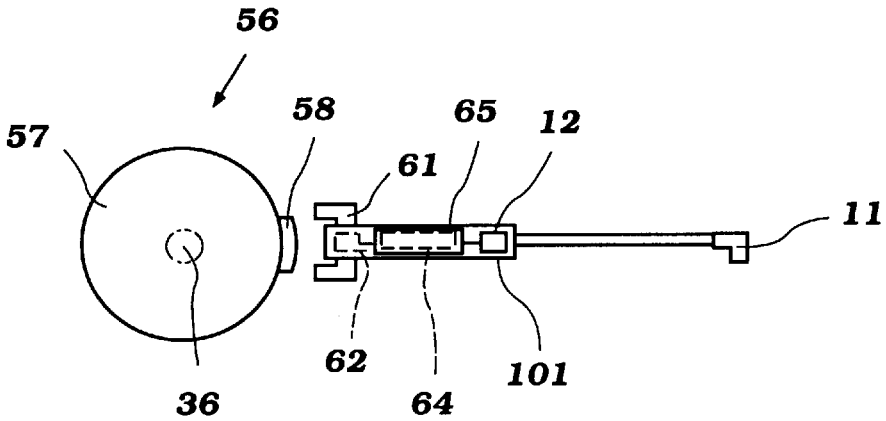

FIG. 6 is a partially schematic view, in part, similar to FIGS. 1*a* and 3, and shows a second embodiment of the invention.

Figure 7:
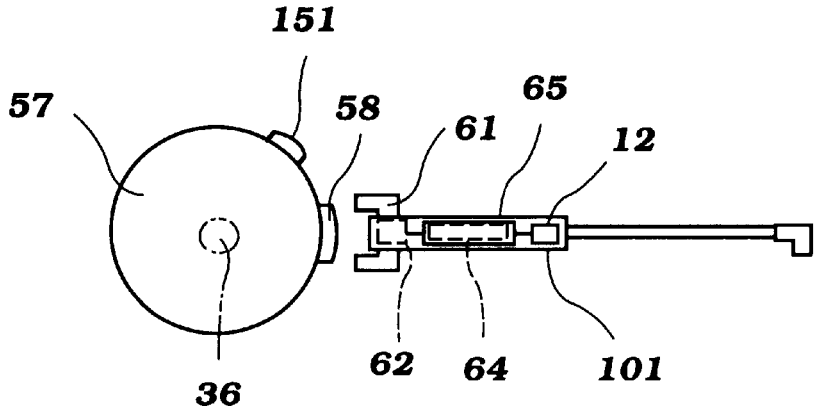

FIG. 7 is a schematic view, in part, similar to FIGS. 1*a*, 3 and 6, and shows a third embodiment of the invention.

Figure 8:
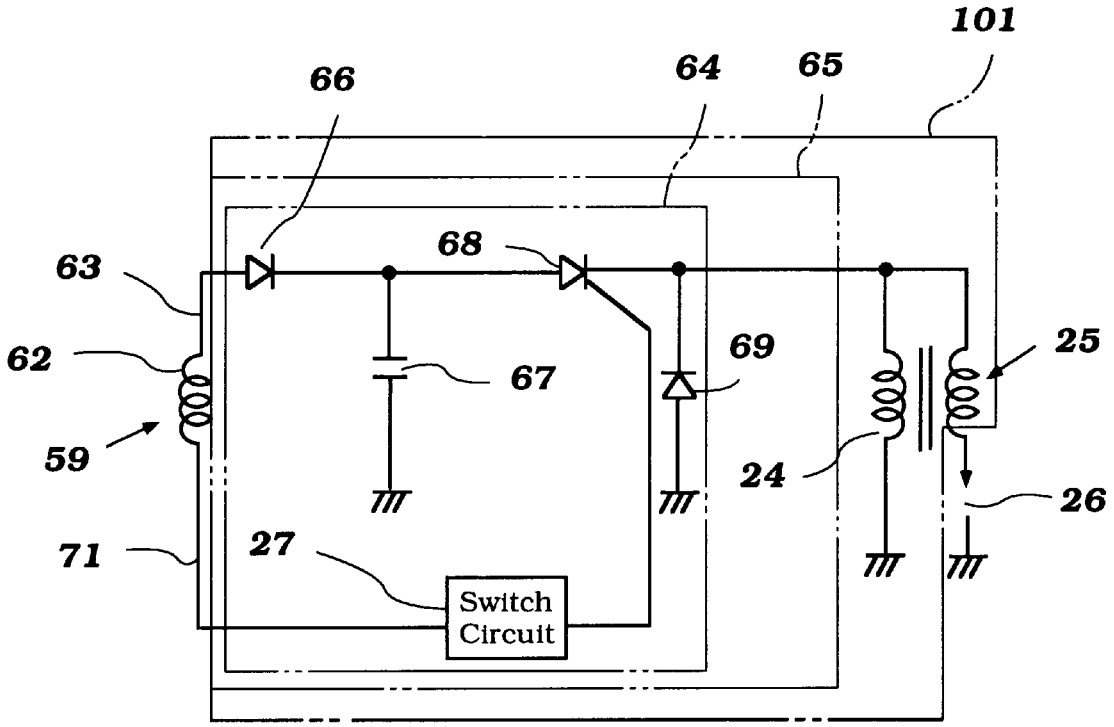

FIG. 8 is a schematic electrical diagram for the embodiment of FIG. 7 and is, in part, similar to FIG. 4.

Figure 9:
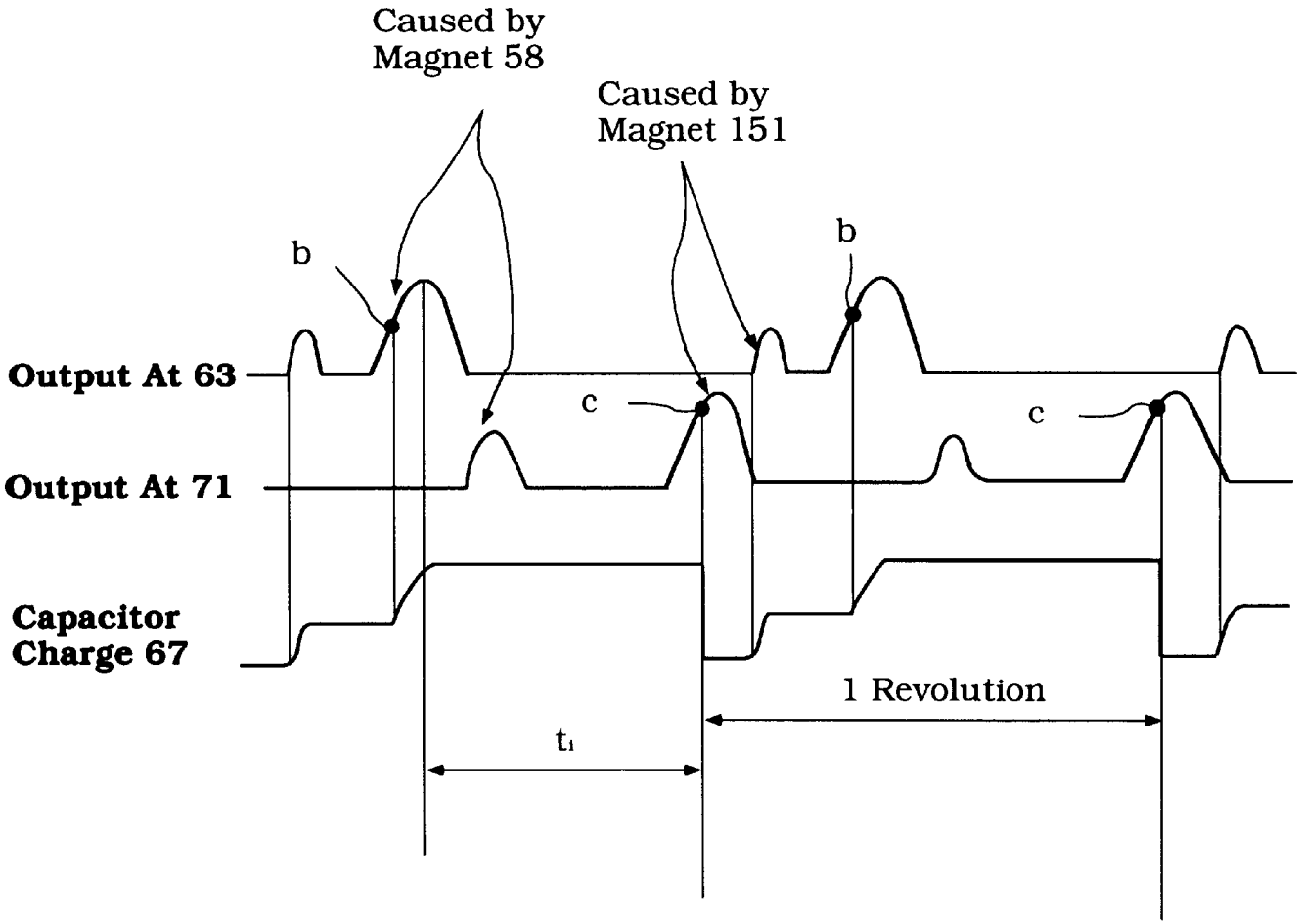

FIG. 9 is a waveform diagram for this embodiment showing the state of various windings and of the capacitor.

Figure 10:
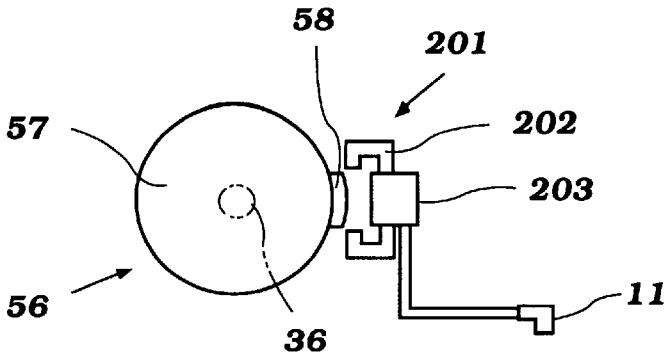
Figure 10:
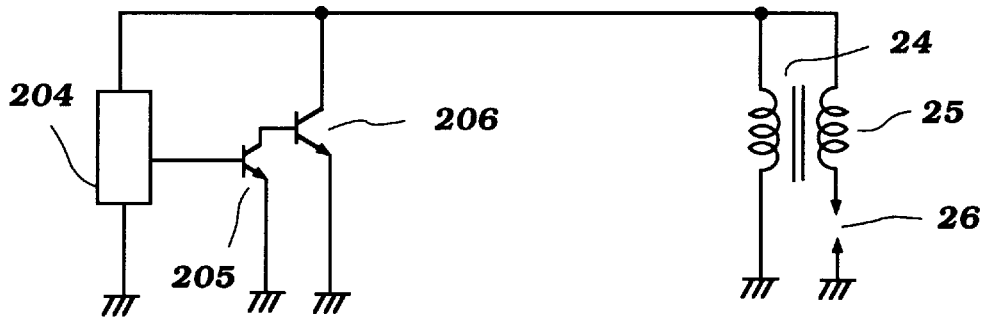
Figure 10:
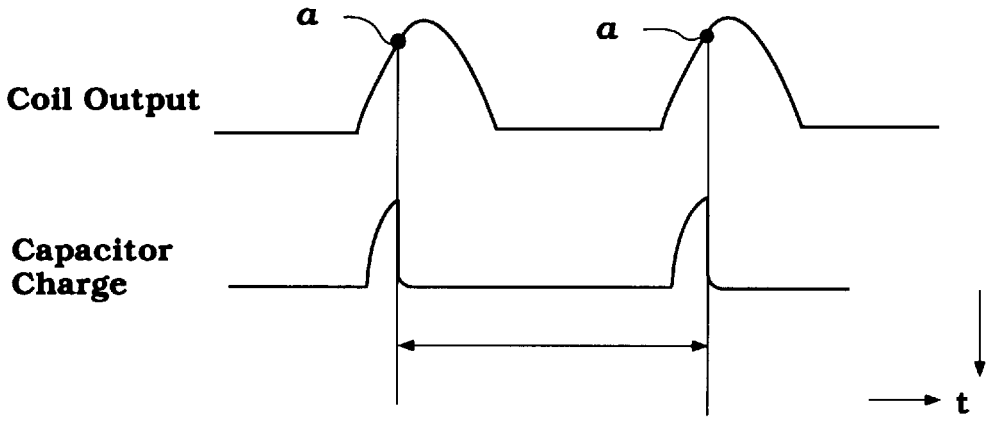

FIG. 10 is a three-part view showing:

in section "a" a schematic view of an ignition system constructed in accordance with a fourth embodiment of the invention;

in section "b," the electrical circuitry of the ignition system; and in section "c," the waveforms showing the state of the charging coil and the capacitor.

DETAILED DESCRIPTION OF THE PREFERRED EMBODIMENTS OF THE INVENTION

Referring first to FIG. 2, an outboard motor is illustrated in this figure and is identified generally by the reference numeral 31. The invention is described in conjunction with an outboard motor because it has particular utility in conjunction with internal combustion engines and, particularly, internal combustion engines that operate on a two-cycle principle. The reason for this is that two-cycle engines require a firing of their spark plugs once every revolution of the crankshaft and, thus, present a more acute problem for the ignition system than with four-cycle engines.

It should be readily apparent to those skilled in the art, however, that the invention can be utilized in conjunction with a wide variety of applications for internal combustion engines and for utilization with internal engines other than two-cycles engines and having other cylinder number and cylinder configurations than those illustrated.

The outboard motor 31 is comprised of a powerhead 32 that consists of a powering internal combustion engine, indicated generally by the reference numeral 33. As will become apparent as the description proceeds, the engine 33 is of the two-cylinder in-line type and operates on a two-stroke, crankcase compression principle. However, and as has been noted above, the invention is capable of use with a wide variety of types of internal combustion engines.

The powerhead 32 is completed by a protective cowling which encircles the engine 33. This cowling is comprised of a lower tray portion 34 and an upper, detachable, main cowling portion 35.

As is typical with outboard motor practice, the engine 33 is mounted in the powerhead 32 so that its crankshaft rotates about a vertically disposed axis. This facilitates coupling by a mechanical coupling 37 to a drive shaft 38. The drive shaft 38 is rotatably journaled within a drive shaft housing 39 that depends from the powerhead 32.

A bevel gear forward, neutral and reverse transmission 41 is provided in a lower unit 42 for driving a propeller shaft 43 and selected forward or reverse directions. A propeller 44 is affixed for rotation with the propeller shaft 33 for providing a propulsion to an associated watercraft, the transom of which is shown in cross-section and which is identified by the reference 45.

As is typical with outboard motor practice, the outboard motor 31 is detachably connected to the watercraft hull transom 45 by a mechanism that permits steering in tilt and trim movement. This mechanism includes a swivel bracket 46 that journals a steering shaft (not shown) that is affixed to the drive shaft housing 39 by upper and lower brackets 47. This permits the steering movement about a generally vertically extending axis.

The swivel bracket 46 is, in turn, pivotally connected by means of a pivot pin 48 to a clamping bracket 49. The pivotal unit about the pivot pin 48 permits the tilt and trim movement of the outboard motor, as is also known in this art. Finally, a clamping device 51 is carried by the clamping bracket 49 for providing a detachable connection on the outboard motor 31 to the transom 45.

The structure of the outboard motor 31 as thus far described may be considered be conventional. As noted above, it is being described only as an environment in which the invention is to be utilized. Therefore, reference may be had to any type of outboard motor construction for an application in which the application may be employed.

Continuing to refer to the details of the engine 33, it includes a cylinder block-cylinder assembly that defines a pair of vertically spaced, horizontally extending cylinder bores 52. Pistons 53 reciprocate in these cylinder bores and are connected by connected rods 54 to the throws of the crankshaft 36 in a manner well known in the art.

As is typical with two-cycle crankcase compression engines, an intake charge of at least air is delivered to sealed crankcase chambers formed by a crankcase member 55 and the cylinder block of the engine 33. This charge is compressed in the crankcase chambers and is transferred through scavenge passages to the combustion chambers formed, in part, by the pistons 53 and the cylinder bores 52.

At some time, fuel is added to this charge and the fuel air charge is then fired by the spark plugs, which are indicated by the reference numeral 26 because they may be considered to be of the same nature as utilized in the prior art construction. In a like manner, the spark plugs are connected to spark terminals 11.

As thus far described, the construction may be considered to be conventional.

In accordance with the invention, a flywheel magneto assembly, indicated generally by the reference numeral 56 is affixed to the upper end of the crankshaft 36 in a known manner and carries permanent magnet 57. This construction also appears in FIG. 3.

The permanent magnet 58 cooperates with a single electromagnetic type sensor assembly, indicated generally by the reference numeral 59 and which is comprised of a u-shaped core 61 and a surrounding winding 62. A single core and single winding are all that is required in accordance with this invention and therefore, the invention dispenses with one of the types of coils and winding utilized in the prior art through its use of the yoke-shaped core 61 and the associated circuitry now to be described.

In accordance with the invention, one end of the winding 62, this end being indicated by the reference numeral 63 is connected to an SCR ignition circuit, indicated generally by the reference numeral 64 and which is contained within a protective outer casing 65 which may be conveniently mounted on the engine at an appropriate location and which cooperates in a manner which will be described with respective spark coils for firing each of the spark plugs 26.

The coil end 63 is connected to a conventional type SCR or CDI ignition circuit consisting of a diode 66 which permits charging of a charging capacitor 67. An SCR 68 connects the coil 67 to ground through a further diode 69. The primary winding 24 of a conventional spark coil 12, as previously described, is in parallel circuit with the diode 69.

The other end of the coil 62, indicated at 71, is connected to a switching circuit 27 which may the same as the conventional type. In other words, this entire circuitry except for the sensor unit 59 is the same as the prior art. However, because of the simplified construction it easily lends itself to encapsulation in a single housing as indicated by the housing 65.

FIG. 5 shows the way in which this circuit works and is controlled again using a family of curves similar to that shown in the prior art FIG. 1*c*. As may be seen, the coil output through the conductor 63 follows a sinusoidal wave and reaches peak at the point "b" at which time the capacitor 67 is fully charged. The opposite end of the coil receives a signal caused by the passage of the permanent magnet 58 past the other core end and this reaches a peak at a time Ti after the coil has been charged as indicated by the point "c".

Thus, it is possible to trigger the spark plug at a much quicker time than previously and hence, the charging capacitor 67 need not hold its charge as long. Nevertheless, the system can fire once every revolution as seen in FIG. 5. Thus, this simplification also provides more latitude and spark timing and obviously simplifies the structure considerably.

FIG. 6 shows another embodiment of the invention which is basically the same as the embodiment of FIGS. 3–5 but in this embodiment, the sensor 59 CDI circuit 64 and spark coil 12 are all encapsulated in a common housing, indicated at 101. This provides obviously a much simpler and more safer arrangement and one which is less likely to be damaged in use.

FIGS. 7–9 show another embodiment of the invention which utilizes the construction shown in FIG. 7. Therefore, components of this embodiment which are the same as that embodiment have been identified by the same reference numerals. This structure will be described again only insofar as is necessary to understand the construction and operation of this embodiment.

In all of the previously-described embodiments, not only was one of the coils and cores of the prior art type devices eliminated but also the necessity for a separate permanent magnet was eliminated. This embodiment, however, shows an arrangement wherein a second permanent magnet, indicated generally by the reference numeral 151 is provided.

By providing this additional permanent magnet, it is possible to charge the capacitor to a higher value as will be understood by reference to FIG. 9. Aside from this, the structure is basically the same and, for that reason, only these differences will be described.

The effect of this embodiment can be best understood by reference to FIG. 9. This figure differs slightly from the previous figures in that it shows in the upper two curves rather the different outputs from the different ends of the coil core, the effect of the two magnets 58 and 151 on the winding are shown.

It will be seen that the output to the capacitor 67 through the coil end 63 has two segments. A first somewhat smaller charging amount caused by the effect of the magnet 151 and a second larger amount caused by the magnet 151. Thus, during the first part of the revolution, the capacitor will be charged by the output of the magnet 151 and this charge held. As the magnet 58 has it effect, the charge will not be built up until after the peak of the first magnet is passed and then the charge will be built up to a greater extent but over a longer time period.

In this instance, the charging by the magnet 58 is indicated at the point b.

Actually, the magnet 151 can be utilized as the triggering pulse and this is indicated at the point c. Thus, the ignition time Ti is the time gap between the maximum charging of the capacitor and the time when the trigger pulse point c is generated.

In the embodiments of the invention as thus far described, the basic CDI circuit has been the same as that utilized in the prior art and the advantages of the invention have been limited primarily to the simplification of the sensor. However, this sensor and charging device also permits the use of an arrangement wherein the electrical circuitry of the CDI system can be simplified.

One of the problems with the prior art construction, as has been noted, is that the charging capacitor must be held in a charge state for sufficient time so as to permit a magnet to come into registry with a separate sensor carried by the pulser coil. Thus, it is necessary to employ the diodes 21 and 23 in the arrangement. However, since a single coil and sensor arrangement can be utilized to provide both the charging and triggering pulse, the diodes can be eliminated and FIG. 10 shows such an embodiment.

In this embodiment, the flywheel magneto basically keeps the same construction as previously described in conjunction with the single magnet embodiments and thus, those components have been identified by the same reference numerals and will not be described again. In this embodiment, the sensor device is indicated by the reference numeral 201 and includes a core 202 and an associated control body 203. This control body 203 includes a winding around the core 202 as previously described and the coil for energizing the spark terminal 111 as well as a circuit shown in the left-hand side of FIG. 10*b*.

This circuit basically includes the output winding from a coil 204 which also includes a circuit connecting the winding end previously applied to the capacitor directly to a capacitor incorporated therein with its output line being connected to the primary winding 23 of the spark coil. The other end of this winding is connected to a first SCR device 205 which in turn switches a second SCR device 206.

As may be seen in FIG. 10*c*, the coil output from the charging coil builds up to a point a and at the same time the capacitor is charged at. At this point and time, however, the output from the other end of the core 202 is sent through an appropriate circuit to switch the first SCR 205 to be on which in effect then switches the SCR 206 to be on and the capacitor is discharged. Thus, the diodes are eliminated because the capacitor is never called on to hold its charge for a time period when the current flow through the winding reverses. Nor falls below its peak. Thus, this embodiment provides a much simplified circuit.

From the foregoing description, it should be readily apparent that the described embodiment of the invention greatly simplify the sensor and coil arrangement for CDI ignition circuit. Of course, it would be readily apparent to those skilled in the art that the apparatus described is merely typical of preferred embodiments of the invention. Various changes and modifications may be made without departing from the spirit and scope of the invention, as defined by the appended claims.

I claim:

1. An ignition circuit for firing a spark plug in an internal combustion engine, said ignition circuit being comprised of a circuit for energizing a primary winding of a step-up coil and comprised of a capacitor and a solid state switching device for effecting discharge of said capacitor for inducing a voltage in said primary winding, a single electromagnetic device for both charging said capacitor and effecting switching of said solid state device through cooperation with at least one magnet rotatable relative to said single electromagnetic device, said single electromagnetic device being comprised of a core surrounded by a winding, said core having its opposite ends disposed in spaced relationship to said magnet for inducing two pulses in said coil upon the relative rotation, said opposite ends being spaced from each other at a distance relative to the rotational path of said magnet such that said magnet rotates substantially less than 180° after passing the first of said ends before passing the other of said ends.

2. The ignition circuit as set forth in claim 1, wherein one of the pulses in employed for charging the capacitor and the other of the pulses is employed for effecting switching of the solid state device.

3. The ignition circuit as set forth in claim 2, wherein the capacitor is discharged once each revolution of the magnet.

4. The ignition circuit as set forth in claim 1, wherein the winding and the ignition circuit are combined in a common case.

5. The ignition circuit as set forth in claim 4, wherein the coil is also contained in the common case.

6. The ignition circuit as set forth in claim 1, wherein there are a pair of permanent magnets cooperating with the coil and core and wherein the permanent magnets are juxtaposed to each other.

7. An ignition circuit for firing a spark plug in an internal combustion engine, said ignition circuit being comprised of a circuit for energizing a primary winding of a step-up coil and comprised of a capacitor and a solid state switching device for effecting discharge of said capacitor for inducing a voltage in said primary winding a single electromagnetic device for both charging said capacitor and effecting switching of said solid state device through cooperation with at least one magnet rotatable relative to said single electromagnetic device, said single electromagnetic device being comprised of a core surrounded by a winding, said core having its opposite ends disposed in spaced relationship to said magnet for inducing two pulses in said coil upon the relative rotation, said ends being disposed in a relationship such that said capacitor is discharged before said charging coil output decreases so as to eliminate the necessity for a diode in the charging circuit.

8. An ignition circuit for firing a spark plug in an internal combustion engine, said ignition circuit being comprised of a circuit for energizing a primary winding of a step-up coil and comprised of a capacitor and a solid state switching device for effecting discharge of said capacitor for inducing a voltage in said primary winding, a single electromagnetic device for both charging said capacitor and effecting switching of said solid state device through cooperation with a pair of circumferentially spaced magnets rotatable relative to said single electromagnetic device, said single electromagnetic device being comprised of a core surrounded by a winding, said core having its opposite ends disposed in spaced relationship to said magnet for inducing two pulses in said coil upon the relative rotation, one of said magnets being employed for charging said capacitor in two steps and the other of said magnets being employed for effecting the switching of said solid state device.

* * * * *